US005325785A

United States Patent [19]

Gardner

[11] Patent Number: 5,325,785

[45] Date of Patent: Jul. 5, 1994

[54] STRAND IGNITION FOR PROPELLANT OF SHELL-COATED PROJECTILE

[75] Inventor: Carl Gardner, Sparta, N.J.

[73] Assignee: The United States of America as represented by the Secretary of the Army, Washington, D.C.

[21] Appl. No.: 492,161

[22] Filed: Mar. 13, 1990

[51] Int. Cl.[5] ..... F42B 5/02

[52] U.S. Cl. ..... 102/430; 102/439; 102/470

[58] Field of Search ..... 102/202, 204, 430, 431, 102/439, 469–470, 472

[56] References Cited

U.S. PATENT DOCUMENTS

| | | | |
|---|---|---|---|
| 99,079 | 1/1870 | Gomez | 102/430 |
| 3,696,749 | 10/1972 | Scanlon | 102/431 |
| 4,763,577 | 8/1988 | Romer et al. | 102/430 |
| 4,917,017 | 4/1990 | Beltz | 102/470 |
| 5,155,295 | 10/1992 | Campoli | 102/430 |

*Primary Examiner*—Harold J. Tudor

*Attorney, Agent, or Firm*—Anthony T. Lane; Edward Goldberg; Michael C. Sachs

[57] ABSTRACT

An ignition device for propellant of a projectile having its aft section extending deeply rearward within a shell case comprises a strand holder, a primer head, and flexible ignition strands with the primer head, when installed, being supported by the shell case and supporting the strand holder which in turn preferably supports the aft end of the projectile. The ignition strands, symmetrically disposed, contact the propellant and in preferred embodiments also contact the projectile, and/or the interior of the shell case, as well as the propellant, and extend along the body section of the strand holder and through conduits therein into a combustion chamber, formed intermediate the installed primer head and a platform section of the strand holder, and with the combustion chamber containing an igniter booster charge susceptible to ignition by a firing means adapted to be used with the primer head.

2 Claims, 3 Drawing Sheets

STRAND IGNITION FOR PROPELLANT-OF SHELL-COATED PROJECTILE

GOVERNMENTAL INTEREST

The invention described herein may be manufactured, used, and licensed by or for the Government for Governmental purposes without the payment to me of any royalties thereon.

FIELD OF THE INVENTION

This invention relates to hardware for a system employing flexible ignition strands for ignition of propellant for a shell-cased projectile in a relatively large caliber ammunition, such as useful in tank guns, naval weaponry, and like cannons, howitzers, guns, etc., with a uniquely modified primer head in combination with a strand holder as well as an ignition device or system employing flexible ignition strands therewith. More particularly, the invention concerns ignition of a propellant bed for a projectile, and especially for a projectile whose aft section extends rearwardly deeply into the propellant bed, which is shell encased, with the ignition employing flexible ignition strands and a modified primer head in combination with the strand holder and the ignition strands.

BACKGROUND AND PRIOR ART AND ADVANTAGES

Cased, large-caliber ammunition, such as rounds for tank guns, artillery, and the like, comprising a projectile and a propellant for the projectile are known and common for various military weaponry. This ammunition ordinarily depends on standard bayonet-type primers and the like for ignition of the propellant, which propels the projectile upon firing of the ammunition round. However, as projectiles useful in ammunition become of such extended length so as to extend rearwardly deeply into the aft portion of the ammunition there is reached a rearward point whereat usage of standard bayonet primers no longer is feasible and/or possible It is believed not known heretofore is: a useful ignition device or system, which employs flexible ignition strands for propellant ignition when the projectile to be propelled by the propellant extends aft so far as to contact a primer head in an ignition device, such as useful upon replacing a customarily employed bayonet-type ignition system for propellant.

The invention's ignition device or system solves problems related to propellant ignition of cased, large caliber ammunition (e.g. for tanks) with deep projectile intrusion into the propellant bed. There are problems which arise when extended length projectiles or penetrators are used. Having reached the point where the intrusion of the penetrator rearward precluded use of any of the standard bayonet primers for propellant ignition, a need arose for devices and new concepts for flexible ignition strands to be extended into the propellant bed. The invention provides a means of (1) initiating the flexible ignition strands; (2) facilitating ammunition LAP (load-assembly-pack), (3) facilitating the downloading of the ammunition should the need arise, (4) supporting the projectile inside the case to improve structural integrity for handling and transportation, and (5) providing projectile stability during early travel when asymmetric forces generate the most destructive transverse moments.

The invention provides a means to initiate strands of ignition material distributed anywhere throughout the propellant bed of cased, large caliber ammunition, including base pad ignition of stick propellant. If there is extended intrusion of the projectile into the case and hence the propellant bed, the invention provides a strand holder, which also will stabilize the projectile during early travel (the first two to three inches) in the bore. The invention requires no design changes of external associated metal parts with, more specifically, no changes being made in the design of the case base. The external appearance of the ammunition round will be unaffected so that no changes in user training will be necessary. The principal modifications of a conventional primer head are: the extension of the mounting threads; the replacement of the primer tube threads with a tapered opening; the press-fit ignition element is the same one that's used in the standard head design; and the closing plug is changed only in that it is shortened on the end away from the black powder charge. This permits utilization of standard internal parts with no or minimal modifications. Extension of the head mounting threads provides a means to attach a strand holder/projectile stabilizer. This not only greatly facilitates the Load-Assemble-Pack (LAP) procedure, but also makes down loading much easier.

Of importance to the invention's ignition device or system is a combination of a primer head and a strand holder. This combination resolves and solves problems related to the application of the invention's ignition device used to initiate strands of propellant ignition material in the bed of large caliber, cased (e.g. tank) ammunition. It is useful with a strand ignition system to replace the standard bayonet primer and especially when projectile intrusion into the propellant bed precludes the use of the bayonet primer. It provides a firm link between the ignition device and ammunition case base, and performs the function of the usual primer head. It thus provides for (1) a primer head enabling usage of ignition strands in the ignition system; (2) greatly simplified ammunition LAP; (3) easier ammunition down loading; and (4) superior projectile support inside the case which improves ammunition structural integrity during transportation and/or rough handling and early projectile launch.

SUMMARY OF THE INVENTION

The invention includes a new and .useful assembly combination of a primer head and strand holder component, as well as an ignition device, which comprises the primer head in relationship with flexible ignition strands and the strand holder so as to function to provide not only ignition and firing of a propelling charge, but preferably also functions to provide projectile support within the ammunition's shell case. Ammunition of particular concern is that which includes a projectile whose aft section extends rearwardly within a shell case and is embedded in or surrounded by propellant which upon firing propels the projectile from the weapon.

The invention's strand holder comprises a) a platform section; b) an aft end adapted to receive a primer head, which primer head includes i) a means adapted to engage and to be supported by a rear end (i.e. base end) of the shell case and to engage and to support said aft end of the strand holder and, while so disposed to engage and support said aft end, to provide a combustion chamber for an igniter booster charge intermediate said primer head and rearward of said platform section, and ii) a means adapted to communicate with said combustion chamber and to hold an igniter means adapted upon activation to ignite said booster charge; c) a forward end section including a forward end; d) a body section longitudinally disposed and connecting said aft end and said forward end with said platform section disposed laterally to said body section and disposed closer to said aft end than to said forward end of said primer head; and e) a plurality of symmetrically disposed conduits and channels, which conduits are passages from said combustion chamber connecting to said channels and which channels extend longitudinally along said body section with each symmetrically disposed conduit connecting to a symmetrically disposed channel. Preferably the forward end section includes a means adapted to contact and to support the aft section of the projectile from radial and lateral movement until a firing of the propelling charge.

The invention's ignition device or system comprises: 1) a strand holder which includes a) a platform section, b) an aft end adapted to receive a primer head, c) a forward end section including a forward end, and preferably a means adapted to contact and to support the aft section of said projectile from radial and lateral movement until a firing of the projectile, d) a body section longitudinally disposed and connecting said aft end and said forward end section with said platform section disposed laterally to said body section and disposed closer to said aft end than to said forward end of said primer head, and e) a plurality of symmetrically disposed conduits and channels, which conduits are passages from a combustion chamber located rearward of said platform section and which conduits connect to said channels, and which channels extend longitudinally along said body section with each symmetrically disposed conduit connecting to a symmetrically disposed channel; 2) a primer head which includes i) a means adapted to engage and support said aft end of said strand holder and is disposed in said aft end and, while so disposed to engage and to support said aft end, to engage and to be supported by the base end of the shell case, ii) a means at a forward end of said primer head adapted to provide said combustion chamber for the igniter booster charge rearward of said platform section, and iii) a means adapted to communicate with said combustion chamber and to hold an igniter means adapted upon activation to ignite said igniter booster charge; and 3) flexible ignition strands symmetrically disposed and contacting the propellant with the flexible ignition strands each of a length adapted to extend from said combustion chamber through a symmetrically disposed conduit and connecting symmetrically disposed channel and therebeyond to provide the symmetrically disposed flexible ignition strands contacting the propellant.

In various embodiments of the invention the channels in the strand holder run forward or rearward, and with these different embodiments employed in the invention's ignition device there are provided corresponding embodiments with flexible ignition strands lodged in the so-located channels and extending therefrom to be held in contact with the projectile or an interior surface of the shell case, or otherwise distributed anywhere desired throughout the propellant as the case may be.

Figure 1:
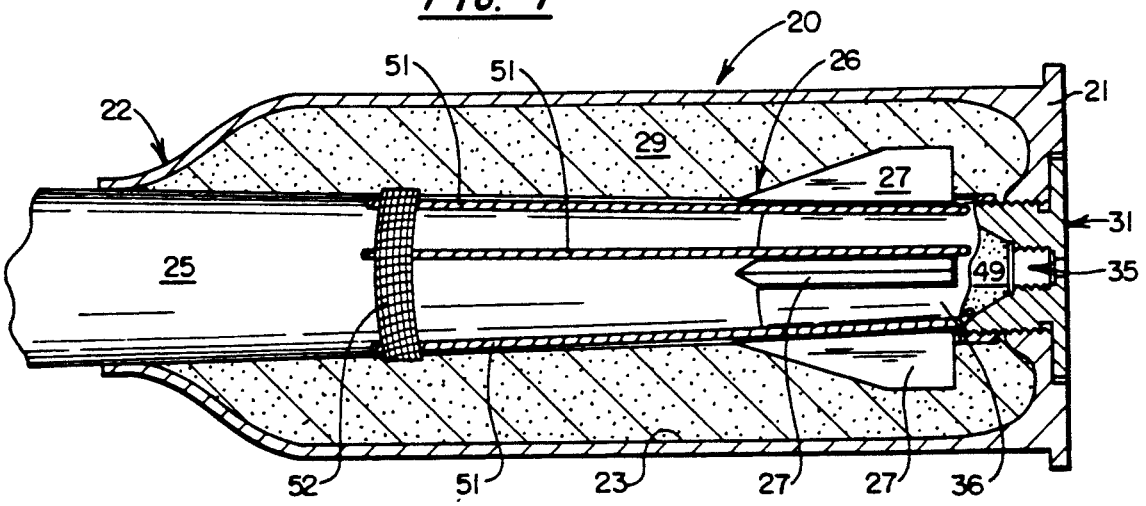
FIG. 1 shows in transverse section the rearward or aft portion of an ammunition piece or round including a shell-encased projectile and propellant therefor employing one embodiment of the invention's strand ignition device or system with the illustrated projectile, ignition strands affixed thereto, and a portion of the strand holder being shown in plan view and the remaining illustrated elements generally shown in longitudinal cross-sectional or broken-away other sectional views.

In the drawing figures the same reference number throughout is used for illustrative purposes for the same component or element, frequently with prime marked numbers when the same or corresponding component or element is found in another embodiment of the invention. In the drawing figures, various features, elements and components are not necessarily drawn to true scale and proportion with the shown scales, proportions and relationships of the components and elements being illustrative only and those of import and utility being clear from their description in the disclosure. Likewise in describing the preferred embodiments, which are illustrated in the drawings, specific terminology has been resorted to for purposes of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

Figure 2:
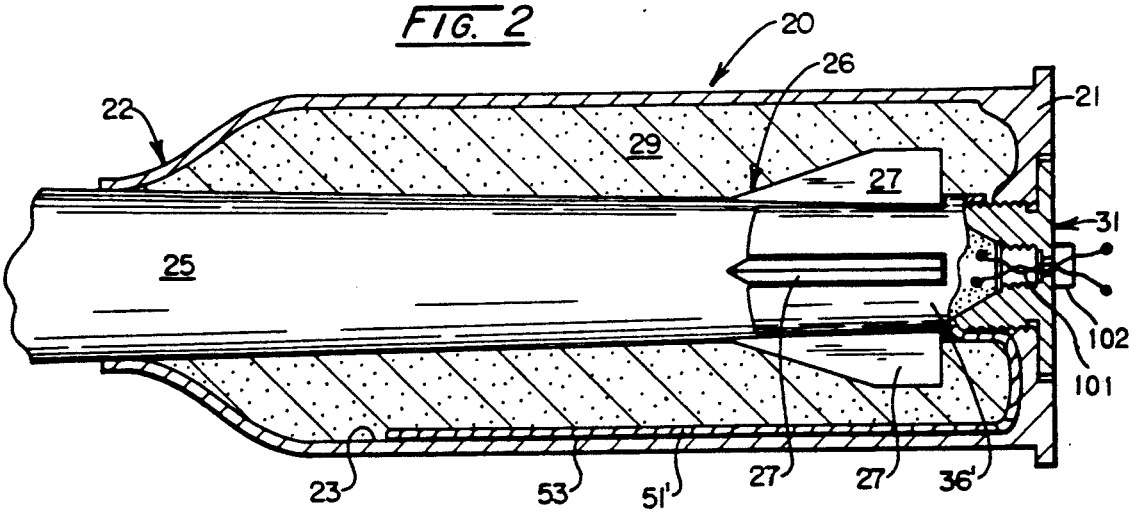
FIG. 2 shows in transverse section the rearward or aft portion of an ammunition piece or round including a shell-encased projectile and propellant therefor employing another embodiment of the invention's strand ignition device and system with the illustrated projectile and a portion of the strand holder being shown in plan view and the remaining illustrated elements generally shown in longitudinal cross-sectional or broken-away other sectional views.
Figure 13:
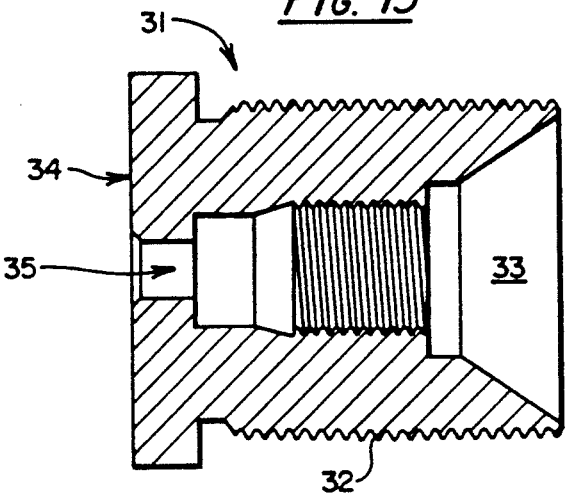
FIG. 13 shows in transverse section a useful modified primer head for use with a strand holder of the invention.
Figure 14:
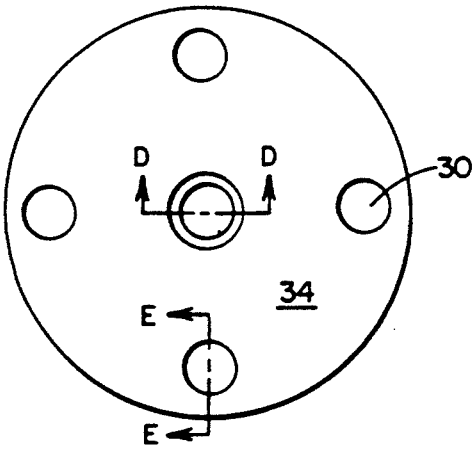
FIG. 14 shows a plan view of the aft end of the primer head illustrated in FIG. 13.
Figure 15:
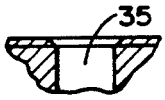
FIG. 15 shows a fragmented sectional view along plane D—D of FIG. 14.
Figure 16:
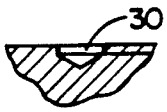
FIG. 16 shows a fragmented sectional view along plane E—E of FIG. 14.

With reference to various illustrative figures, in FIGS. 1 and 2 there are illustrated respectively, two embodiments of ammunition rounds employing various embodiments of the ignition device. A shell case, generally designated 20, includes a base or rear end 21 as well as a forward crimped or necked-down section 22 and an interior side wall surface 23. A projectile (e.g. KE penetrator), generally designated 25, has a section thereof contacted by and held by the crimped or necked-down section 22 of shell case 20. The illustrated projectile 25 includes a rearward or aft section, generally designated 26, from which there radially protrudes a plurality of fins, individually designated 27. Inside the shell case 20 and radially surrounding the aft section 26 of the projectile is a propellant, generally designated 29. In the rear end 21 of shell case 20 there is shown a primer head 31 whose elements and features are more clearly apparent from FIGS. 13–16. Primer head 31 is mounted in the rear or base end 21 of shell case 20 so as to be installable therein and also removable therefrom and, when installed therein, to be securely and fixedly held by rear end 21 and also to securely and fixedly hold a strand holder, generally designated 36, 36' or 36''. Primer head 31 at its forward end include a means 33 (see FIG. 13, for instance), so contoured (e.g conically tapered) that in conjunction with strand holder 36, 36' or 36'' there is formed a combustion chamber 47, (see FIGS. 3, 7, 10, for instance) which in FIGS. 1 and 2 embodiments is filled with an igniter booster charge 49. Various elements and features of strand holder 36 and alternative embodiments 36' and 36'' will be apparent from the illustrative FIGS. 3 through 12. As illustrated in FIGS. 1 and 2, each fin 27 of the projectile 25 passes through a slot 37 in the forward end section 38 of the strand holder 36 or 36', and the forward end 39 or 39' of the forward end section 38 of strand holder 36 or 36' also makes contact with the projectile 25 at its aft section 26. The combination of fins 27 through slots 37, respectively, and also the contacting of the forward end 39 or 39' with the projectile function as an illustrative means serving to contact and support the aft section 26 of the projectile from movement while installed in the shell case 20. In the FIG. 1 and 2 illustrative ammunition embodiments there are a plurality of flexible ignition strands 51 and 51' in symmetrically disposed conduits 45 and 45' connecting to symmetrically disposed channels 44 and 44'. In the FIG. 1 illustrative embodiment, the flexible ignition strands 51 extend in length from combustion chamber 47, (see FIGS. 3, 7, 10, for instance), wherein they contact igniter booster charge 49, through conduit 45 and in channel 44 and beyond along and in symmetric disposition on the surface of projectile 25 to which they are held in contact by means of a tape 52. In the FIG. 2 illustrative embodiment, the flexible ignition strands 51' extend in length from combustion chamber 47, (see FIGS. 3, 7, 10, for instance) wherein they contact igniter booster charge 49, through conduit 45' and in channel 44' and beyond extending in symmetric disposition along the interior side-wall surface 23 of shell case 20 whereat they are held in contact thereto by an adhesive 53.

Figure 3:
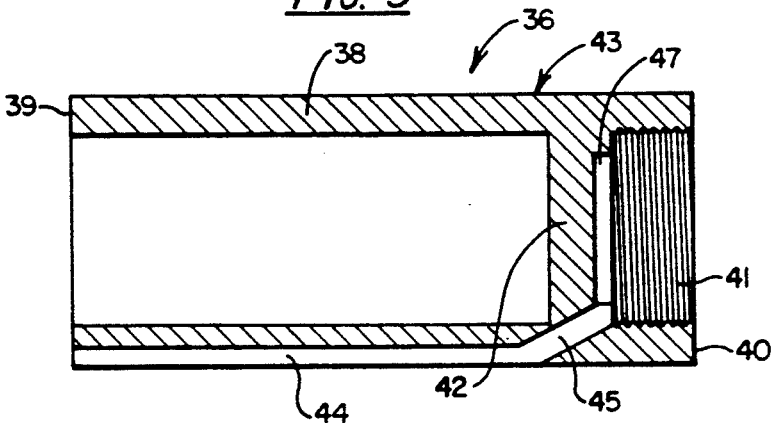
FIG. 3 shows in transverse section a strand holder of the invention.
Figure 4:
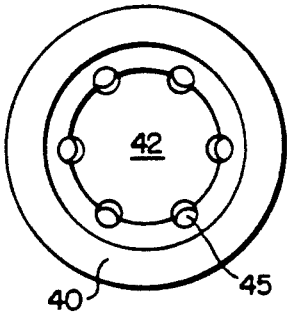
FIG. 4 shows a plan view of the aft end of the strand holder illustrated in FIG. 3.
Figure 5:
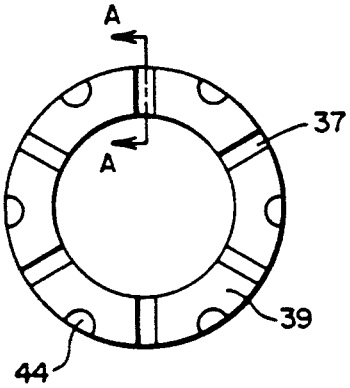
FIG. 5 shows in plan view the forward end of the strand holder illustrated in FIG. 3.
Figure 6:
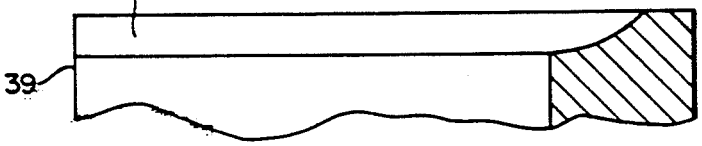
FIG. 6 shows a sectional view along plane A—A of FIG. 5.
Figure 7:
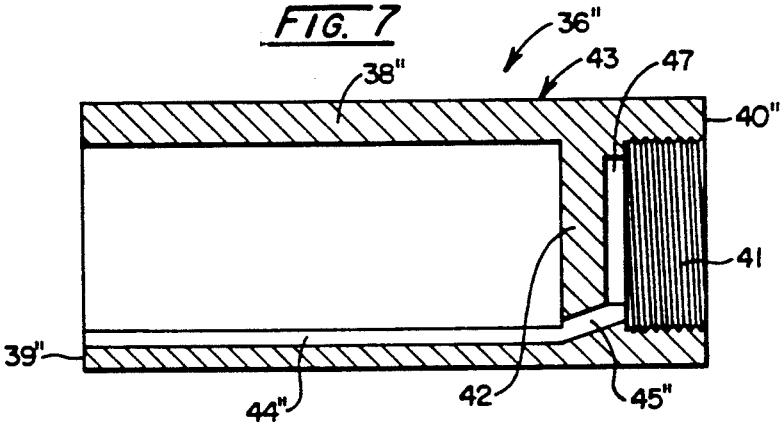
FIG. 7 shows in transverse section another strand holder of the invention.
Figure 9:
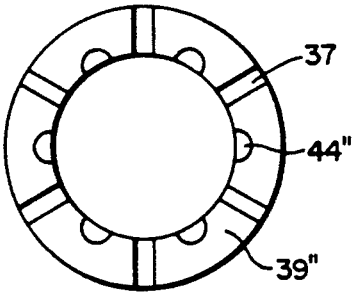
FIG. 9 shows a plan view of the forward end of the strand holder illustrated in FIG. 7.
Figure 8:
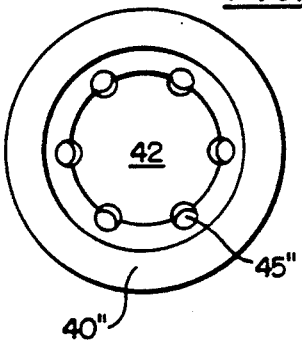
FIG. 8 shows a plan view of the aft end of the strand holder illustrated in FIG. 7.
Figure 10:
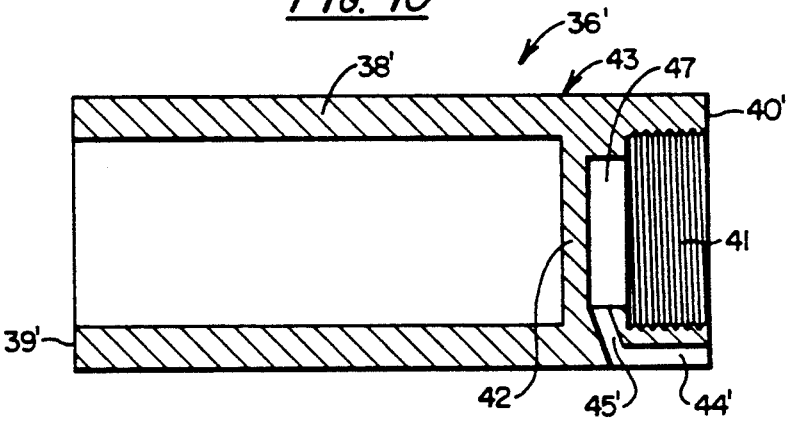
FIG. 10 shows in transverse section still another strand holder of the invention.
Figure 11:
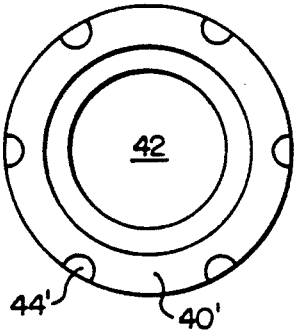
FIG. 11 shows a plan view of the aft end of the strand holder illustrated in FIG. 10.
Figure 12:
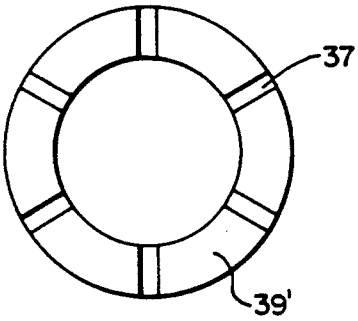
FIG. 12 shows a plan view of the forward end of the strand holder illustrated in FIG. 10.

With reference to illustrative FIGS. 3 through 12, in FIGS. 3, 7 and 10 there are illustrated several embodiments of strand holder, generally designated 36, 36'' and 36', respectively in their respective figures. Each strand holder includes an aft end designated 40, 40' or 40'', respectively, a forward end 39, 39' or 39', respectively, a forward end section 38, 38' or 38'', respectively, a body section generally designated 43 having respective aft and forward ends, a platform section 42, slots individually designated 37, and shown at least in part a combustion chamber 47. Also shown in these strand holder embodiments are conduits 45, 45' or 45'', respectively, leading from combustion chamber 47 to channels 44, 44' or 44'' respectively, each conduit symmetrically disposed with respect to other conduits and each channel symmetrically disposed with respect to other channels and each conduit leading to and connecting to an individual channel. In each strand holder there is shown a thread means 41 extending from aft end 40, 40' or 40'' toward platform section 42, which thread means 41 is adapted to receive and mate with a corresponding thread means 32 of primer head 31. By using uniform threads for thread means 41 in the strand holder as well as thread means 32 of the primer head 31 along the length of the plug and also as threads (not clearly illustrated) in rear end 21 of shell case 20, the primer head 31 can be screwed into or withdrawn from the case end 21 and the strand holder 36, 36' or 36'' at the same time and without affecting spacing between the shell case 20 and combustion chamber 47 when the strand holder at its aft end 40, 40' or 40'' contacts the base or rear end 21 of shell case 20.

FIGS. 13 through 16 detail views illustrating a useful primer head, generally designated 31, useful in conjunction with the various embodiments illustrating strand holder 36, 36' and 36''. The already mentioned thread means 32 of primer head 31 is adapted to mate with and engage the thread means 41 of a strand holder and when so disposed to engage and support the aft end 40, 40' or 40'', respectively of the strand holder. Thread means 32 also is adapted to engage and to be supported by the rear end 21 of shell case 20. Primer head 31 at its one end, that end initially screwable into thread means 41 of a strand holder, includes a hollow end section generally designated 33, and as illustrated a truncated conical hollow, so that with primer head 31 in engagement with and supporting a strand holder this hollow end section 33 will be disposed immediately rearward of platform section 42 of a strand holder and in conjunction with the strand holder provide the combustion chamber 47, which will be able to contain igniter booster charge 49. The other end, generally designated 34, of the primer head 31 includes an opening and passage 35 therethrough leading to hollowed end section 33 and also, when primer head 31 is engaged to and supporting a strand holder, leading into combustion chamber 47. End 34 of primer head 31 includes a plurality of cavities 30, which cavities are arranged and adapted so as to be able to receive a bridged-fork-like tool (not illustrated) in matingly engagement, and when so engaged by the tool, adapts the primer head 31 to rotatable functional movement for screwing into rear end 21 of shell case 20 and into engagement with thread means 41 of the strand holder. The opening or passage 35 in primer head 31 is such as adapted to receive and hold any of numerous conventional ignition elements or firing means, which upon weapon firing ignite the igniter booster charge 49. A typical useful firing means could be a press-fit ignition element or plug or the like 101 (as shown in FIG. 2) containing an ignition element of a bridgewire 102 embedded within igniter booster charge 49 and with leads extending through the plug to a source of contact by the weapon. Upon firing of the weapon, an electrical current is passed through the bridgewire to provide a firing voltage pulse, which consequently heats the bridgewire to a point causing ignition of the igniter booster charge 49, which in turn ignites the flexible ignition strands 50 or 51' and they in turn ignite the propellant 29 causing the projectile 25 to fire and to be discharged from the weapon.

With reference to FIGS. 3-6 and in somewhat greater detail, the illustrated strand holder 36, when employed to receive fins 27 or an assembly of fins 27, such as of a KE penetrator, may have a forward end section 38 about three inches in length, which may be lengthened or shortened, if appropriate, and which contains slots 37 to receive fins 27 and contains channels 44, to receive the ignition strands 51. Slots 37 cut completely through the wall of section 38 and permit the fins to protrude through, allowing the inner cylinder wall of section 38 to fit as closely to the cylindrical part of the fin assembly as necessary. Channels 44 are embedded into, but not through, the cylinder wall of section 38—either on the outside and forward, as illustrated in FIGS. 1 and 3, respectively, or the outside and rearward, as illustrated in FIGS. 2 and 10, respectively, between the fin slots which provide passages for the ignition strands 51, in FIG. 1, and for strands 51' to extend to disposition on side wall 23 of shell case 20. Rearward of the fins 27, or an assembly section of fins 27, is a platform section 42 of the strand holder which provides a firm rest to hold the end of the projectile 25 or the fin assembly there against. The forward end section 38 can be lengthened for shorter projectiles. Of significance is that combustion chamber 47, which is located rearwardly of platform section 42, is created by a primer head 31 and thread means 32 and 41, which match the standard threads on fixed ammunition shell cases where a customary or standard primer head would be normally inserted.

Assembly of ammunition employing the invention may be as follows. Ignition strands 51 or 51' would be inserted into the appropriate conduits 45, 45' or 45'' to rearward of the platform section 42 and allowed to protrude slightly (for example, $\frac{1}{8}'' \pm 1/16''$) into the combustion chamber 47. A means, either chemical on mechanical, if needed, could be used to hold the ends of the strands in place. The flexible ignition strands 51 or 51' extend from the conduits 45, 45' or 45'' into channels 44, 44' or 44'' and therebeyond. In the FIG. 1 embodiment the ignition strands extend from the channels forward of the fins 27 to a length suitable to perform the propellant bed ignition function. An invention's strand holder 36, 36' or 36'' with the strands 51 or 51' in place, would be slid onto the aft section 36 of the projectile with fins 27 sliding into slots 37. The ignition strands would then be attached to the projectile body or shell case 20, or the case may be, by any means chemical or mechanical. One chemical means could be an adhesive strip on one side of the strand with a protective cover strip (not illustrated). When the device is slid into place, the protective strip could be removed and the strand pressed against the projectile 25 or shell case 20, bonding it in place. One mechanical means could be the preformed channels 44, 44' or 44'' or grooves (not illustrated) in the projectile body. The strand would be placed in the channels or grooves, and their edges crimped at points, locking the strand in place. For the FIG. 1 embodiment with the strand holder and strands 51 attached to the projectile, this projectile assembly could be placed in the case 20 and fastened (or crimped), for example at crimped section 22 of shell case 20. If permissible in the LAP procedure, the primer head 31 could already be in place in the rear end 21 of shell case 20 and the projectile assembly could be torqued onto the thread means 32 of the closing plug 31 before being fastened forward such as at crimped section 22 of the shell case. If LAP procedure does not permit turning of the projectile in the case during ammunition assembly, the projectile assembly could be indexed upon the assembly being inserted into the case 20. The primer head 31 could then be threaded first into the case rear end 21 and into the strand holder 36, 36' or 36'' in one operation. Down loading could then be effected by simply removing the primer head 31.

Loading of propellant 29 in the shell case 20 and placing igniter booster charge 49 in its combustion chamber 47 may take place during ammunition assembly in the normal sequence in which such steps ordinarily would take place in manufacture of conventional ammunition rounds comprising shell-cased projectiles and ignition devices including igniter booster charge.

Materials for the shell case and the projectile are those of customary usage. The primer head 36, 36' and 36'' and closing plug 31 may be fabricated of ASTM-A108(1117, 1213, 12L14, 1215) steel. Materials, however, could be altered to include brass, aluminum, high strength plastics, etc., as long as the chosen material meets requisite strength requirements, etc.

Useful and particularly employed compositions for propellant 29, igniter booster charge 49, flexible ignition strands 51 and 51', as well as useful ignition elements, projectiles, etc. are those known to the art for conventional ammunition and may be selected by one of skill in the art with regard to the intended purpose of the ammunition and the weaponry of concern. However, to mention a few, useful propellants include M1, M6, M30, M31, and the like; useful igniter booster charges include black powder granules, CBI, and the like; useful flexible ignition strands may comprise many commercially available items including ITLX and any consumable case strands, etc. Useful ignition elements include electrically heated bridgewire, percussion compositions, and the like. Although the illustrated projectile in FIG. 1 and FIG. 2 embodiments include fins, projectiles without fins and also of other configurations, such as are known to the art, may be used, with in such instances the forward end section 38, 38' or 38'' and forward end 39, 39' or 39'' of the strand holder being appropriately modified in contour to adapt to contact and support the specific aft section 26 of the particularly employed projectile or, if desired, not to contact and support the projectile.

Functioning of the ammunition round in the chamber would be identical to any other rounds of ammunition. Upon firing, an ignition element in the primer head 31 would function to ignite the igniter booster charge 49, such as a black powder charge, which would fill the combustion chamber 47 with high temperature high pressure gas that, in turn, ignites the ends of the ignition strands 51 or 51' that extend into the combustion chamber 47. The flame front proceeds up the strands 51 or 51' igniting the propellant 29 as it burns. At this point in preferred embodiments, the projectile is supported at two stations along its length; the bourrelet or section 21 of shell case 20 and the aft section 26 and particularly fins 27. This multiple support provided by the invention improves the structural integrity and greatly reduces transverse torque and balloting motion during early projectile travel when asymmetric forces due to irregular propellant ignition would be highest This additional support at the rear or the round of ammunition is also very helpful in preventing internal transverse movement of the projectile with resulting damage during transportation and rough handling Attachment of the ignition strands to the projectile also help to reduce asymmetric forces on the fin end of the projectile by bringing it into contact with the propellant gases while the pressure is lowest. This avoids slapping the projectile with an uneven high-pressure wave.

Although not illustrated, a still further embodiment of the invention is contemplated This particular embodiment can be deemed a modification or extension of the embodiment illustrated in FIG. 2 and would utilize a stick form instead of a granular or powder form of propellant. In this embodiment, the conduits 45' would be angled rearward as illustrated in FIG. 10 and the strand's channels 44' on the outside surface would extend rearward also as shown in FIG. 10. Short flexible ignition strands would extend from the combustion chamber through the conduits and in the channels to near or on the inside surface of the rear end of the shell case and extend radially outward on the inside surface of the base or rear end of the shell case. An annular base ignition pad then would be disposed over the radially disposed strands and be in contact therewith and held in such contact by the stick form of propellant. Annular base ignition pads are known to the art and generally comprise CBI (clean burning igniter) or black powder.

A modification (not illustrated) of this just-described embodiment, without the annular base ignition pad but still including the radially disposed flexible ignition strands also is contemplated in instances where it is desirable to mount ignition strands both in contact with the shell case and the projectile, and with the strand holder modified to include both forward and rearward conduits. Still other contemplated embodiments would not require channels in the strand holder, but the ignition strands from the conduits 45, 45' or 45'' would proceed directly into contact with the propellant and be disposed in any desirable disposition therein with or without means, such as channels, tape, adhesive or the like to distribute and maintain the strands at a desired location in contact with the propellant.

Assembly of various of these embodiments could be even simpler than for the forward-running strands since the strand holder, strands, base pad, and stick propellant all could be placed prior to the projectile being inserted into the shell case. Down loading via primer head removal, and stabilizer operation, would be akin to that of other described embodiments The foregoing specific embodiments of the invention are intended to teach the best mode and to illustrate and show feasibility of the invention. Numerous changes in design and appearance are possible and will be apparent to one of skill in the art and such changes in design and appearance are contemplated as within the scope of the invention so long as the basic functions and means of the invention fall within those changes. Thus, it will be apparent to those of skill in the art that improvements can be made in the foregoing described embodiments of the invention without departing from the scope of the invention, and accordingly the foregoing descriptive disclosure is to be construed in an illustrative sense with the true scope of the invention being defined solely by the appended claims.

Having thus described the invention, what is claimed is:

1. In an improved cartridge having a shell case housing a propellant and having an ignition device to activate the propellant, an improvement in said ignition device comprising provision of strands of ignitable material, said strands being adjacent, a surface of said propellant; a one piece strand holder for said strands, said one piece strand holder having a body with integral forward and aft portions said body being hollow and cylindrical, and having a platform being flat and fitted within said body, and further having a combustion chamber adjacent to said platform in near relationship to the aft portion of said body, a primer head for said body, and said combustion chamber also housing an igniter booster charge; igniter means communicating with said combustion chamber for the ignition of said booster charge; and a plurality of conduits and channels extending longitudinally along said body of said strand holder in communication with said combustion chamber, said conduits and channels receiving said strands, said conduits communicate between said combustion chamber and said channels holding said ignition strands whereby the ignition of said booster charge in said combustion chamber by the igniter means in sequence will ignite said strands which will act to ignite said propellant.

2. The cartridge of claim 1 wherein said channels are symmetrical and extend longitudinally along said body from the conduits, each of said channels receiving a separate ignition strand, said strands being flexible.

* * * * *